US011364170B2

(12) United States Patent
Lee et al.

(10) Patent No.: US 11,364,170 B2
(45) Date of Patent: Jun. 21, 2022

(54) JOINT MOBILIZATION APPARATUS

(71) Applicant: Asia University, Taichung (TW)

(72) Inventors: Shin-Da Lee, Taichung (TW); Cheng-Ju Wu, Taichung (TW); Wei-Chun Hsu, Taichung (TW); Hong-Jun Yeh, Taichung (TW)

(73) Assignee: Asia University, Taichung (TW)

( * ) Notice: Subject to any disclaimer, the term of this patent is extended or adjusted under 35 U.S.C. 154(b) by 323 days.

(21) Appl. No.: 16/699,009

(22) Filed: Nov. 28, 2019

(65) Prior Publication Data

US 2020/0170872 A1 Jun. 4, 2020

(30) Foreign Application Priority Data

Nov. 29, 2018 (TW) ..... 107142711

(51) Int. Cl.
*A61H 1/02* (2006.01)

(52) U.S. Cl.
CPC ..... *A61H 1/0218* (2013.01); *A61H 1/0281* (2013.01); *A61H 2201/1215* (2013.01); *A61H 2201/1253* (2013.01); *A61H 2201/164* (2013.01); *A61H 2201/165* (2013.01); *A61H 2201/1633* (2013.01); *A61H 2201/1666* (2013.01); *A61H 2201/1669* (2013.01); *A61H 2201/1676* (2013.01)

(58) Field of Classification Search
CPC ..... A61H 1/0218; A61H 1/0281; A63B 22/0002; A63B 23/035
See application file for complete search history.

(56) References Cited

U.S. PATENT DOCUMENTS 3,835,847 A * 9/1974 Smith ..... A61H 1/0218 602/36
4,291,686 A * 9/1981 Miyashiro ..... A61H 1/0218 601/101
5,449,336 A * 9/1995 Sabel ..... A61H 1/0218 482/133
5,480,375 A * 1/1996 La Fosse ..... A61H 1/0229 601/23
9,393,453 B2 * 7/2016 Watterson ..... A63B 21/4035
2008/0293545 A1 * 11/2008 Planke ..... A63B 7/00 482/7
2009/0306568 A1 * 12/2009 Meyer ..... A61H 1/0218 602/33

* cited by examiner

*Primary Examiner* — Timothy A Stanis
(74) *Attorney, Agent, or Firm* — Wang Law Firm, Inc.

(57) ABSTRACT

A joint mobilization apparatus includes a pulling unit and a power unit. The pulling unit includes a wearable member set for mounting on the patient's joint part, and a rope set connected to the wearable member set. The power unit provides power of reciprocatingly pulling the rope set, and includes a shell member, a motor, and a reciprocation mechanism connected to the motor and the rope set. The reciprocation mechanism is driven by the motor to reciprocate relative to the shell member, so as to pull the rope set to reciprocate the wearable member set and patient's joint part. By using the power unit to drive the pulling unit to pull reciprocatingly for mobilizing the patient's joint part, instead of the therapist's treatment, the therapist's burden in physical strength can be reduced. Furthermore, the joint mobilization apparatus can provide the user to execute various muscle training modes.

11 Claims, 19 Drawing Sheets

JOINT MOBILIZATION APPARATUS

CROSS-REFERENCE TO RELATED APPLICATION

This application claims priority from Taiwan Patent Application No. 107142711, filed on Nov. 29, 2018, in the Taiwan Intellectual Property Office, the content of which is hereby incorporated by reference in its entirety for all purposes.

BACKGROUND OF THE INVENTION

1. Field of the Invention

The present invention relates to a rehabilitation apparatus, more particularly to a joint mobilization apparatus.

2. Description of the Related Art

Joint mobilization is a commonly used rehabilitation technique, which is performed by a therapist to manually position and apply the joints and related limbs of the patient to separate and pull the joint in a specific direction, so as to improve joint mobility, relieve pain and restore joint function. However, for the therapist, the implementation of joint mobilization is extremely labor-intensive and time-consuming; in recent years, the doctors to patient ratio is gradually increasing, so therapist often faces several patients in a day. It is a great burden for the therapist, and the patient also has to rely on the therapist to rehabilitate and soothe the joints.

SUMMARY OF THE INVENTION

An objective of the present invention is to provide a joint mobilization apparatus which is able to reduce a therapist's burden in physical strength, and facilitate a therapist and patient to operate independently.

In order to achieve the objective, the present invention provides a joint mobilization apparatus comprising a pulling unit and a power unit. The pulling unit comprises a wearable member set configured to mount on a patient's joint part, and a rope set connected to the wearable member set. The power unit is configured to provide power of reciprocatingly pulling the rope set. The power unit comprises a shell member, a motor disposed on the shell member, and a reciprocation mechanism disposed on the shell member and connected to the motor and the rope set, the reciprocation mechanism is driven by the motor to reciprocate relative to the shell member, so as to pull the rope set to reciprocate the wearable member set and patient's joint part.

The effect of the joint mobilization apparatus of the present invention is that the power unit can drive the pulling unit to pull reciprocatingly, to mobilize the patient's joint part, instead of therapist, so as to reduce the therapist's burden in physical strength and facilitate the patient to use independently.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
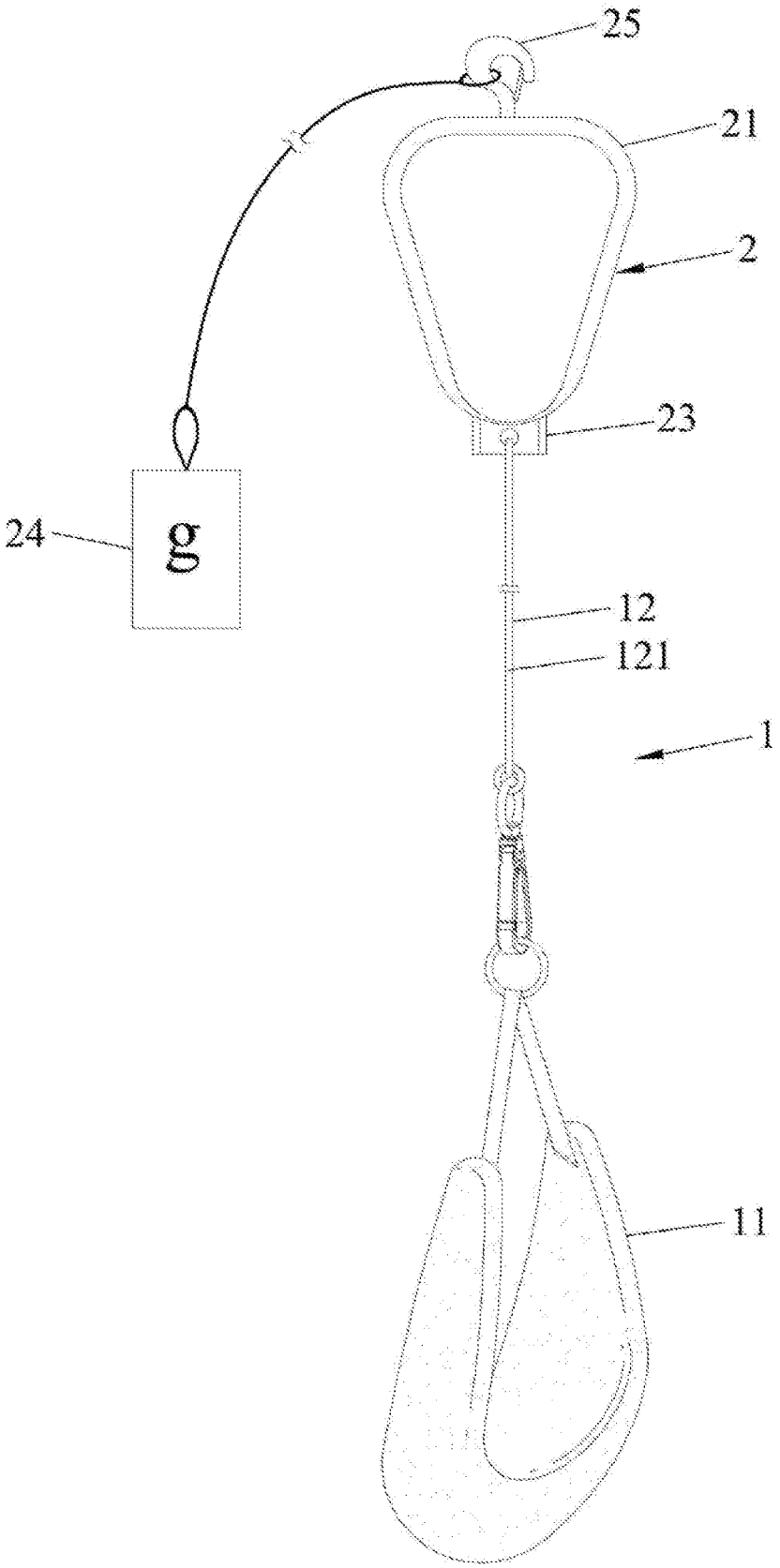
FIG. 1 is a perspective view of a first embodiment of a joint mobilization apparatus of the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise", "include" and "have", and variations such as "comprises", "comprising", "includes", "including", "has" and "having" will be acknowledged to imply the inclusion of stated elements but not the exclusion of any other elements.

Figure 2:
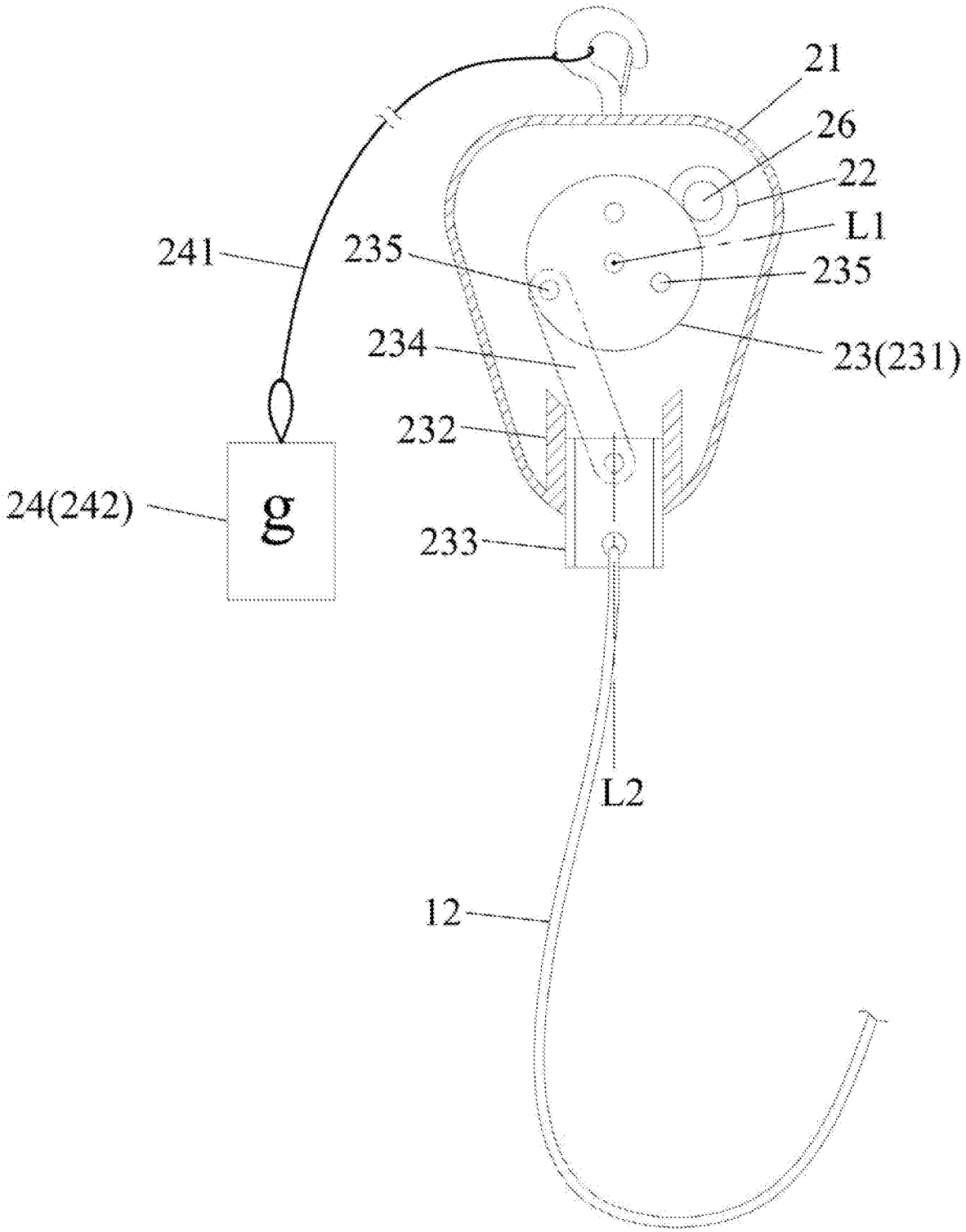
FIG. 2 is a schematic plan view of a part of the first embodiment without the shell member, for illustrating an assembly state of internal members of the shell member.

Please refer to FIGS. 1 and 2. A first embodiment of a joint mobilization apparatus of the present invention comprises a pulling unit 1 and a power unit 2.

The pulling unit 1 comprises a wearable member set 11 and rope set 12. The wearable member set 11 is configured to mount on the patient's joint part, and the rope set 12 is connected to the wearable member set 11. In this embodiment, the rope set 12 has a rope 121 connected to the wearable member set 11 and the power unit 2.

The power unit 2 is configured to provide power of reciprocatingly pulling the rope set 12, the power unit 2 comprises a shell member 21, a motor 22 disposed on the shell member 21, a reciprocation mechanism 23 disposed on the shell member 21 and connected to the motor 22 and the rope set 12, a weight member set 24 detachably connected to the shell member 21, and a hook member 25 disposed on the shell member 21. The reciprocation mechanism 23 is driven by the motor 22 to reciprocate relative to the shell member 21, so as to drive the rope set 12 to pull the wearable member set 11 and the patient's joint part, reciprocatingly. The weight member set 24 comprises a rope 241 detachably connected to the hook member 25, and a weight member 242 connected to an end of the rope 241 opposite to the shell member 21. In this embodiment, the reciprocation mechanism 23 comprises a rotary disk 231 disposed inside the shell member 21 and rotatably mounted on the shell member 21 about a first axis L1, a guiding holder 232 disposed on the shell member 21 and in communication with the inside and outside of the shell member 21, a sliding member 233 slidably disposed on the guiding holder 232 along a second axis L2 perpendicular to the first axis L1, a link rod 234 having a length direction perpendicular to the first axis L1 and having two ends pivoted with the rotary disk 231 and the sliding member 233, respectively. However, the reciprocation mechanism 23 of the present invention is not limited to above-mentioned example. The link rod 234 is pivotally connect to the terminal of the rotary disk 231 and deviated from the first axis L1. The sliding member 233 is connected to the rope set 12 of the pulling unit 1. The motor 22 includes a pinion gear 26 disposed on an output shaft thereof, and the rotary disk 231 is a large gear with a half diameter larger than that of the pinion gear 26 and engaged with the pinion gear 26. The motor 22 is connected to the rotary disk 231 via the pinion gear 26, and configured to drive the rotary disk 231 to rotate, so as to drive the sliding member 233 to slide reciprocatingly relative to the guiding holder 232 along the second axis L2. It is to be noted that a gear ratio of the pinion gear 26 to the rotary disk 231 can be set to meet the actually required output rotation speed and torque according to the practical demand. In this embodiment, the pinion gear 26 is used to drive the large gear (rotary disk 231) to achieve the effect of reducing the output rotation speed, thereby preventing from too-fast vibration frequency; furthermore, in other embodiment, the pinion gear 26 can be replaced by a gear set which is formed by multiple gears, and is not limited to single gear.

In this embodiment, the rotary disk 231 can comprise a plurality of pivot points 235 which are deviated from the first axis L1 and configured to pivot with the link rod 234. Distances from the pivot points 235 to the first axis L1 are not the same. The link rod 234 is detachably pivoted on one of the pivot point 235.

Figure 3:
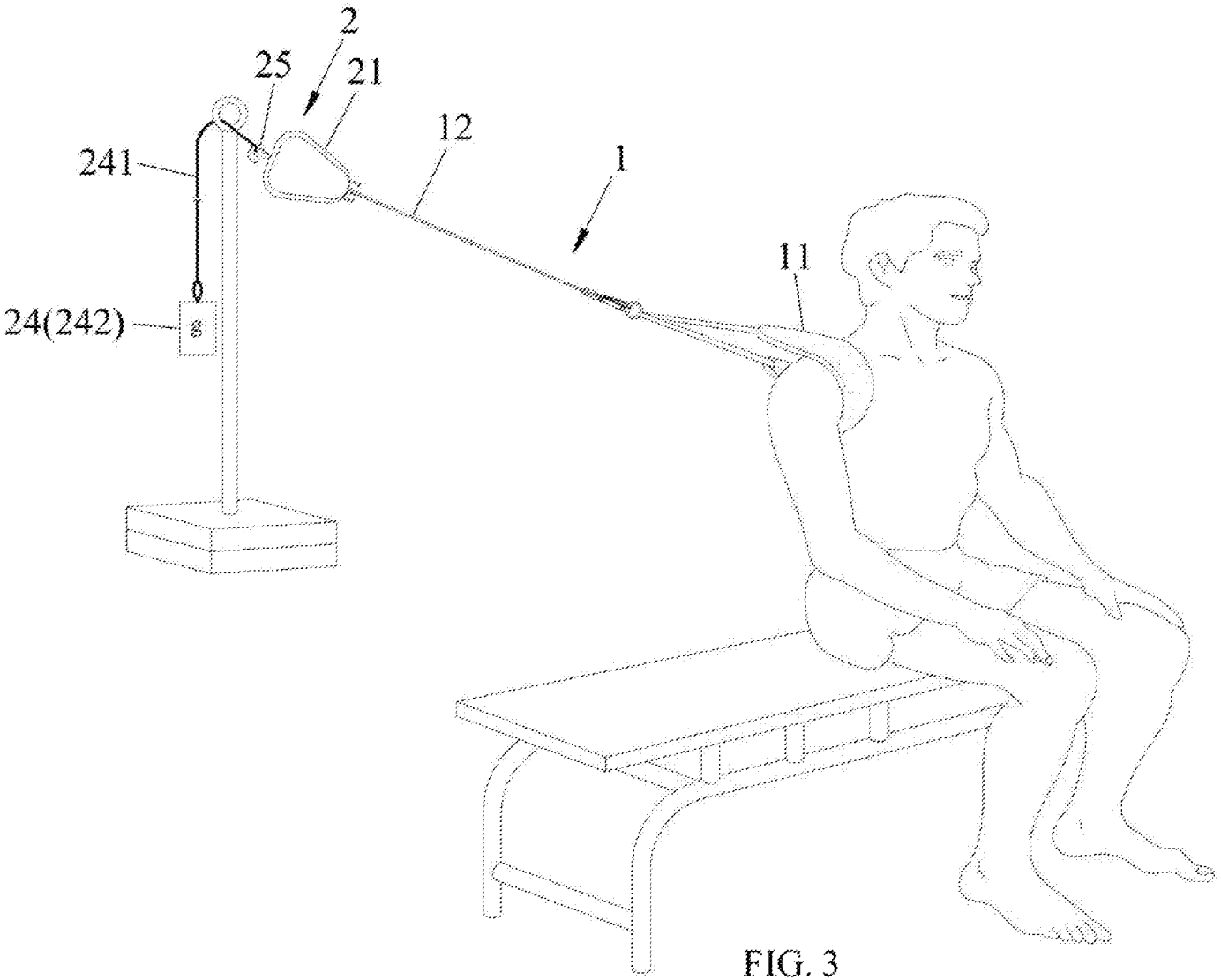
FIG. 3 is a schematic view of an operation of using the first embodiment, to illustrate that the patient uses the first embodiment independently to backwardly mobilize shoulder joint.
Figure 4:
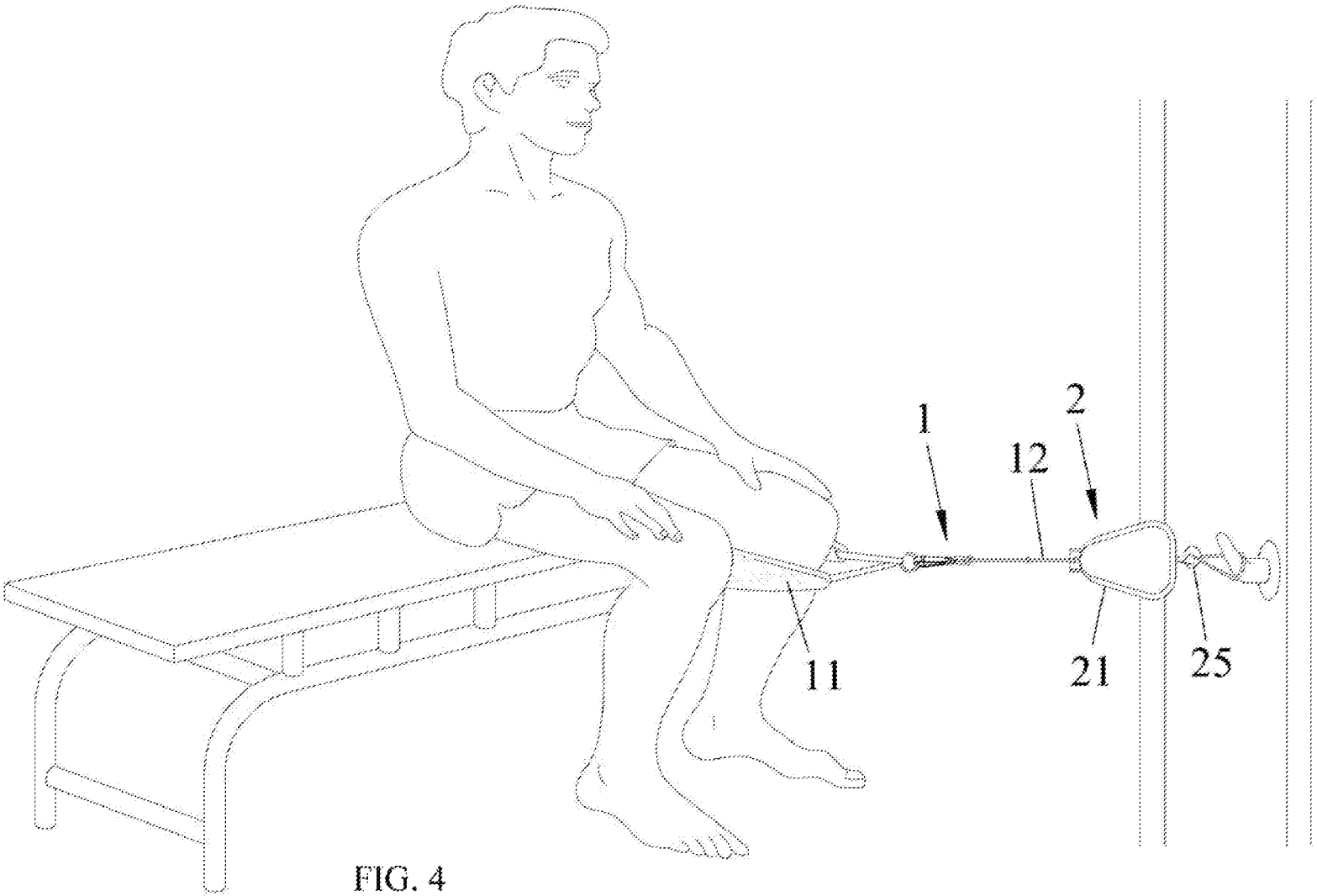
FIG. 4 is a schematic view of an operation of using the first embodiment of the present invention, to illustrate that the patient uses the first embodiment independently to forwardly mobilize a knee joint thereof.

Please refer to FIG. 2 to 4. As shown in FIG. 3, in order to operate the joint mobilization apparatus of the present invention, a patient can hang the rope 241 of the weight member set 24 on a fixed object such as a ring hook, a support frame or fixed pulley in environment; or the patient can take off the weight member set 24 and hook the hook member 25 on the fixed object in environment, as shown in FIG. 4. Next, the patient can mount the wearable member set 11 of the pulling unit 1 on the joint part to be mobilized, and adjust the body direction to move the rope set 12 to the to-be-mobilized direction of the joint part. FIG. 3 illustrates that a patient independently operates the first embodiment to backwardly mobilize a shoulder joint thereof, FIG. 4 illustrates that a patient independently operates the first embodiment to forwardly mobilize a knee joint thereof. After a pulling direction of the rope set 12 is adjusted completely, the patient can turn on the motor 22 to drive operation of the reciprocation mechanism 23, so as to drive the rope set 12 to pull reciprocatingly the wearable member set 11 and the patient's joint part, thereby achieving the effect of pulling and mobilizing the joint part. In detail, the first embodiment uses the weight member 242 to increase a tension of pulling the rope set 12 under a condition that a tension of the rope set 12 is insufficient; in other embodiment, the weight member set 24 has a hanging ring or pulley (not shown in figures) slidably disposed on the rope 241, and a user can hang the hanging ring or pulley on a fixed object in environment, and slidably insert the rope 241 into the hanging ring or pulley. Furthermore, in the first embodiment, the position (that is, one of the pivot point 235) where the link rod 234 being pivotally connected to the rotary disk 231 can be changed to adjust the frequency of pulling the rope set 12.

Figure 5:
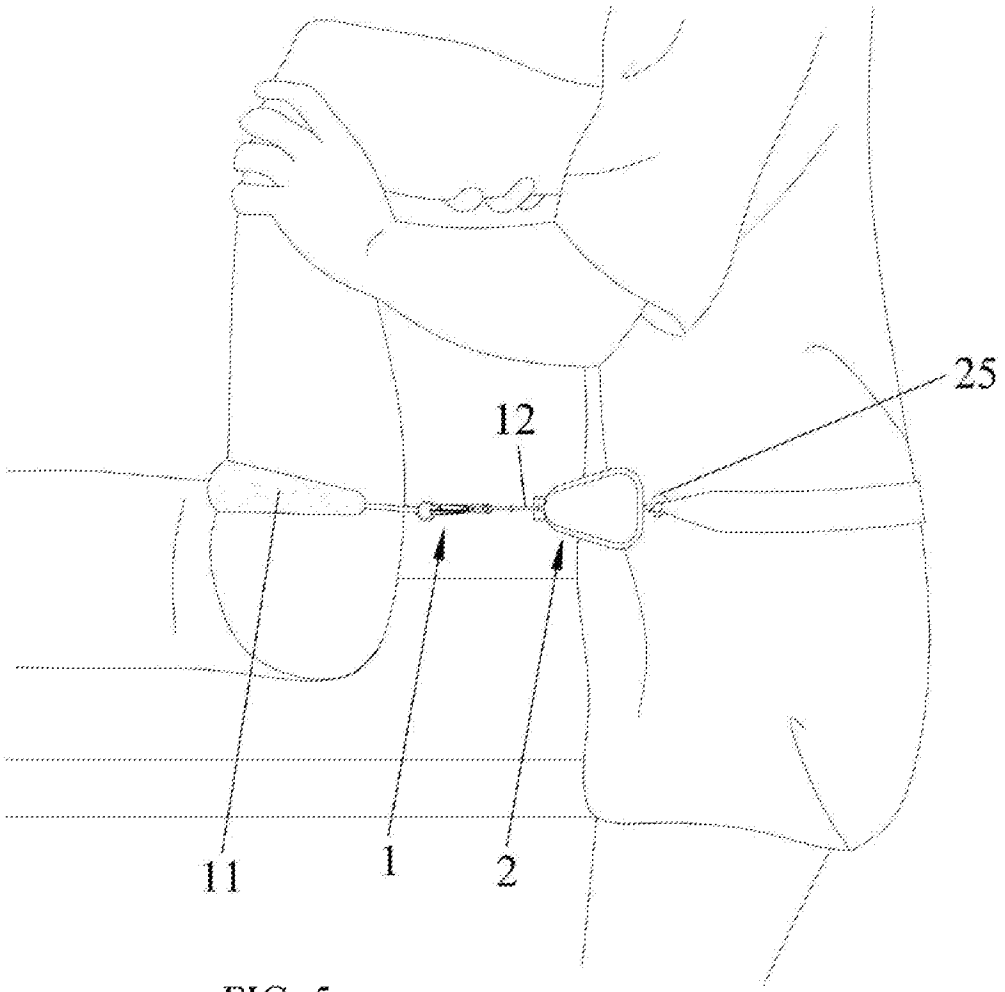
FIG. 5 is a schematic view of an operation of using the first embodiment of the present invention, to illustrate that a therapist uses the first embodiment to mobilize a patient's hip joint.

Furthermore, besides enabling a patient to independently operate, the first embodiment also can assist a therapist to perform joint mobilization on a patient. Please refer to FIGS. 2 and 5. The therapist can fasten the power unit 2 on a body thereof or a fixed object in environment, and then mount the wearable member set 11 on a patient's joint part to be mobilized, and after the pulling directions of the patient body and the rope set 12 are adjusted, the motor 22 can be turned on to pull and mobilize the patient's joint part, and as shown in FIG. 5, which illustrates that the therapist operates the first embodiment to perform joint mobilization on the patient's hip joint.

Figure 6:
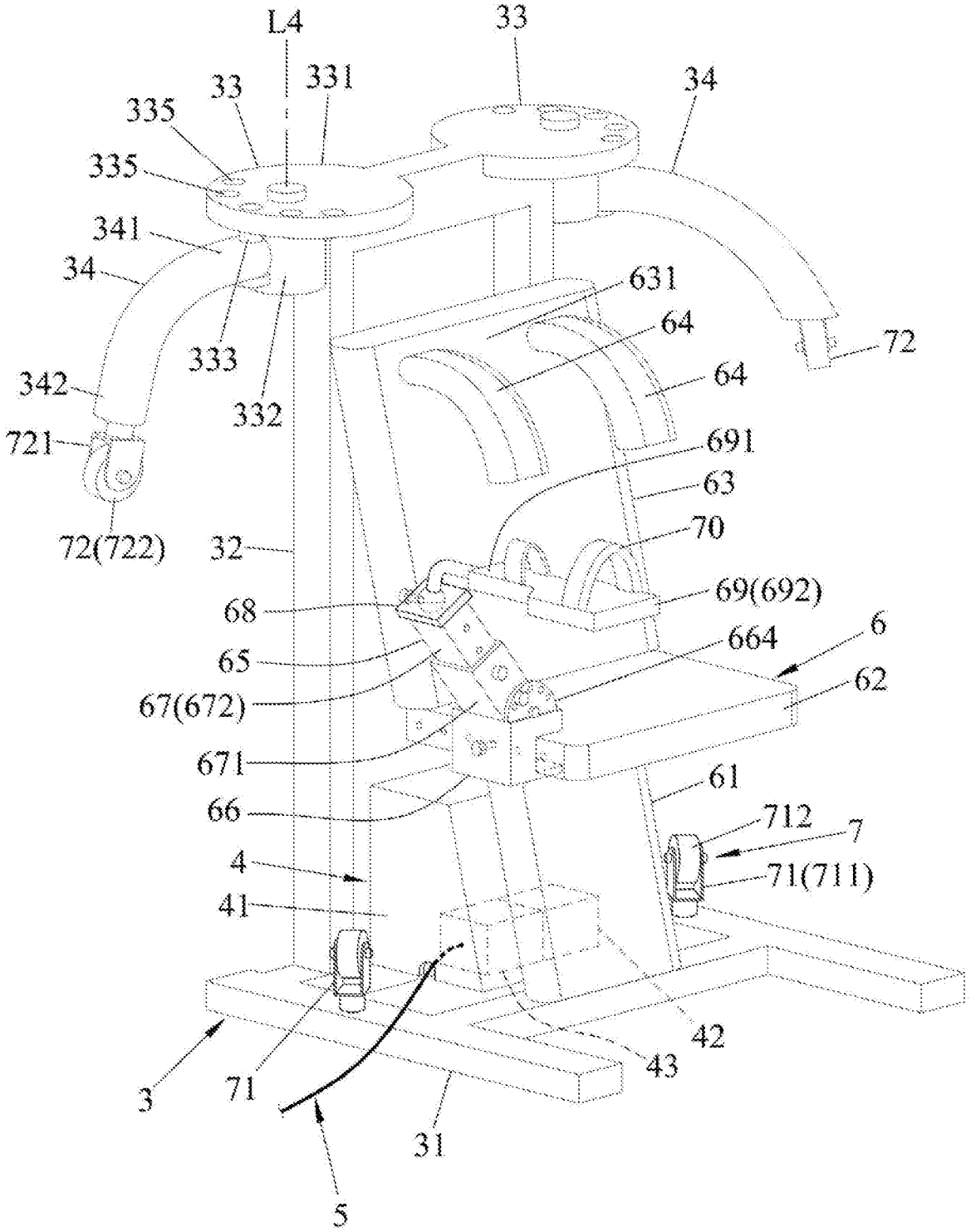
FIG. 6 is a perspective view of a second embodiment of a joint mobilization apparatus of the present invention.
Figure 10:
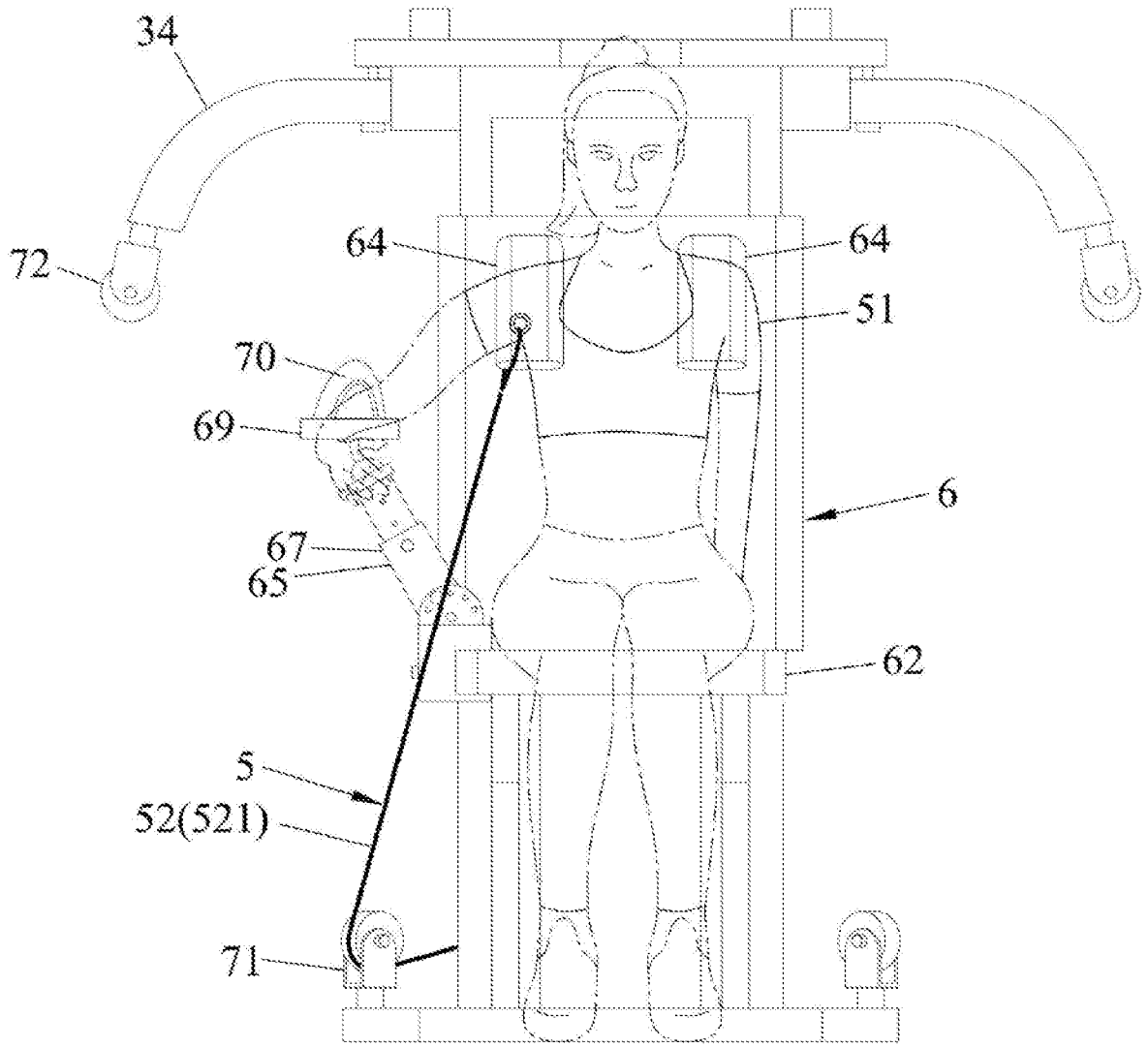
FIG. 10 is a schematic view of an operation of using the second embodiment of the present invention, to illustrate that the patient operates the second embodiment to downwardly mobilize a shoulder joint thereof.

Please refer to FIGS. 6 and 10, which show a second embodiment of a joint mobilization apparatus of the present invention applicable to mobilize the patient's shoulder joint, the joint mobilization apparatus comprises a base unit 3, a power unit 4, a pulling unit 5, a chair 6, and a turning unit 7.

Figure 7:
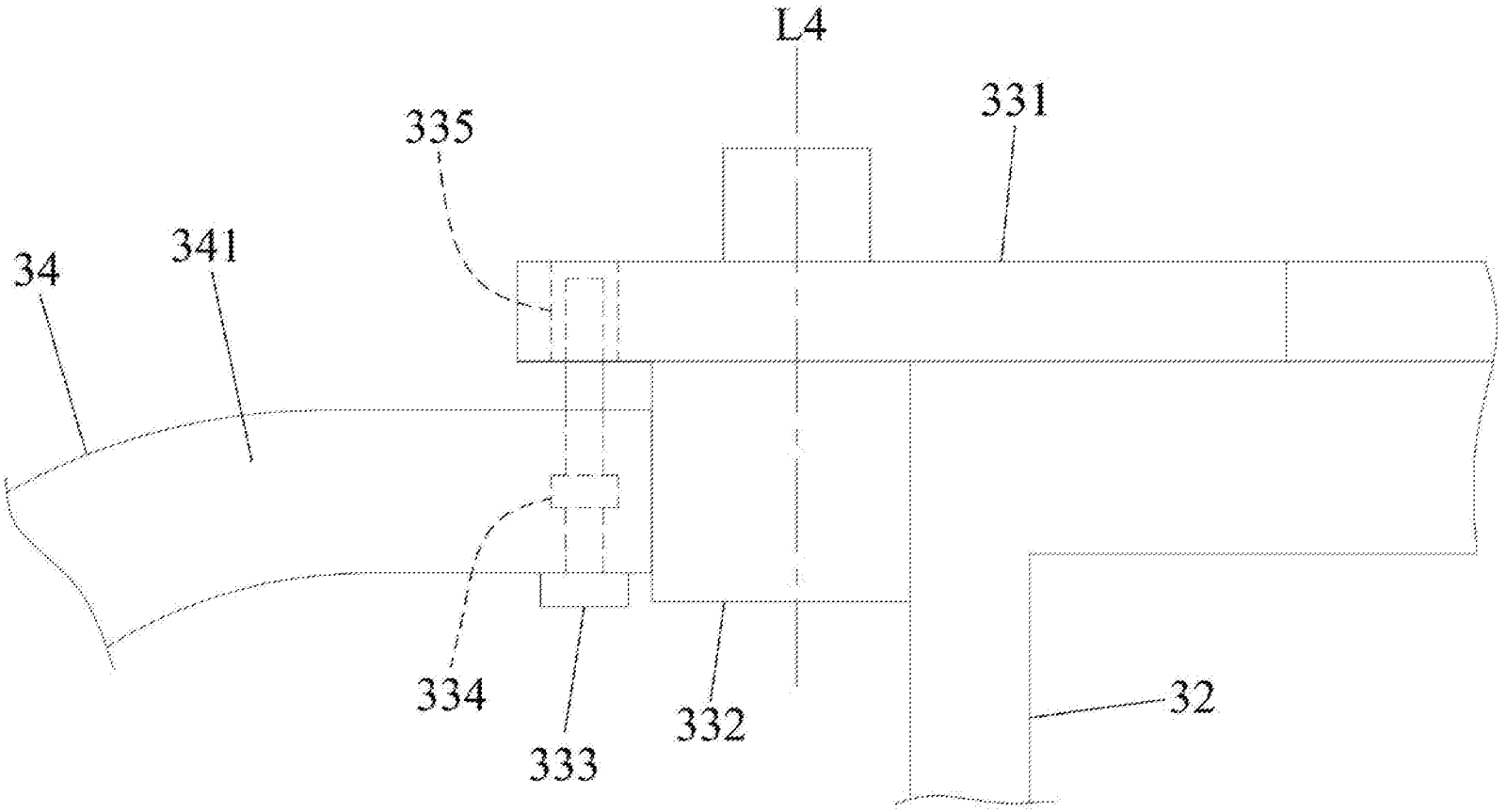
FIG. 7 is a perspective view of a part of a base unit of the second embodiment of the present invention.

Please refer to FIGS. 6 and 7. The base unit 3 comprises a base 31, a base frame 32 disposed on the base 31 and extended upwardly, two positioning member sets 33 respectively disposed on left and right sides of a top of the base frame 32, and two swingable arms 34 connected to the positioning member set 33 and respectively extended in directions away from the base frame. Each of the plurality of swingable arms 34 comprises a first end 341 connected to the positioning member set 33, and a second end 342 opposite to the first end 341. Relative to the positioning member set 33, the second end 342 is rotatable about the fourth axis IA which passes through the positioning member set 33 and is extended in longitudinal direction. The positioning member set 33 is configured to position the swingable arm 34. In this embodiment, each of the plurality of positioning member sets 33 comprises a positioning disk 331 disposed on a top of the base frame 32 and having a plurality of positioning holes 335, a shaft 332 rotatably disposed on the positioning disk 331 and rotatable about the fourth axis IA and connected to the swingable arm 34, a positioning pin 333 inserted into the swingable arm 34 and the positioning hole 335, and an elastic member 334 configured to connect the swingable arm 34 and the positioning pin 333 to enable the positioning pin 333 to be constantly inserted in the direction toward the positioning hole 335. The positioning pin 333 can be pulled out of the positioning hole 335. However, the structure of the positioning member set 33 of the present invention is not limited to the example described herein. In other embodiment, the base unit 3 can include one swingable arm 34 and one positioning member set 33, and the swingable arm 34 and the positioning member set 33 are disposed on the same side of the base frame 32.

The power unit 4 comprises a shell member 41 fixed to the base 31, a motor 42 disposed in the shell member 41, and a reciprocation mechanism 43 disposed inside the shell member 41 and connected to the motor 42. The reciprocation mechanism 43 is driven by the motor 42 to reciprocate relative to the shell member 41. In this embodiment, the motor 42 can be a servo motor, and the rotational velocity and output torque of the motor 42 can be controlled to adjust. The reciprocation mechanism 43 is connected to an output shaft of the motor 42 to output the power of the motor 42 in a straight reciprocation motion. The structure of reciprocation mechanism 43 can be similar to that of the first embodiment, but the present invention is not limited thereto.

Please refer to FIG. 10. The pulling unit 5 can comprise a wearable member set 51 configured to mount on the patient's joint part, and a rope set 52 connected to the wearable member set 51 and the reciprocation mechanism 43. The rope set 52 can be driven by the reciprocation mechanism 43, to pull the wearable member set 51 and the patient's joint part to reciprocate. In this embodiment, the rope set 52 can have a rope 521. In other embodiment, the pulling unit 5 includes a reel disposed in the shell member 41 and configured to roll the rope 521 of the rope set 52, so as to control a length of the rope 521. Furthermore, in this embodiment, the wearable member set 51 is in the form of upper garment and has a metal ring for insertion of the rope set 52, but the present invention is not limited thereto.

Figure 8:
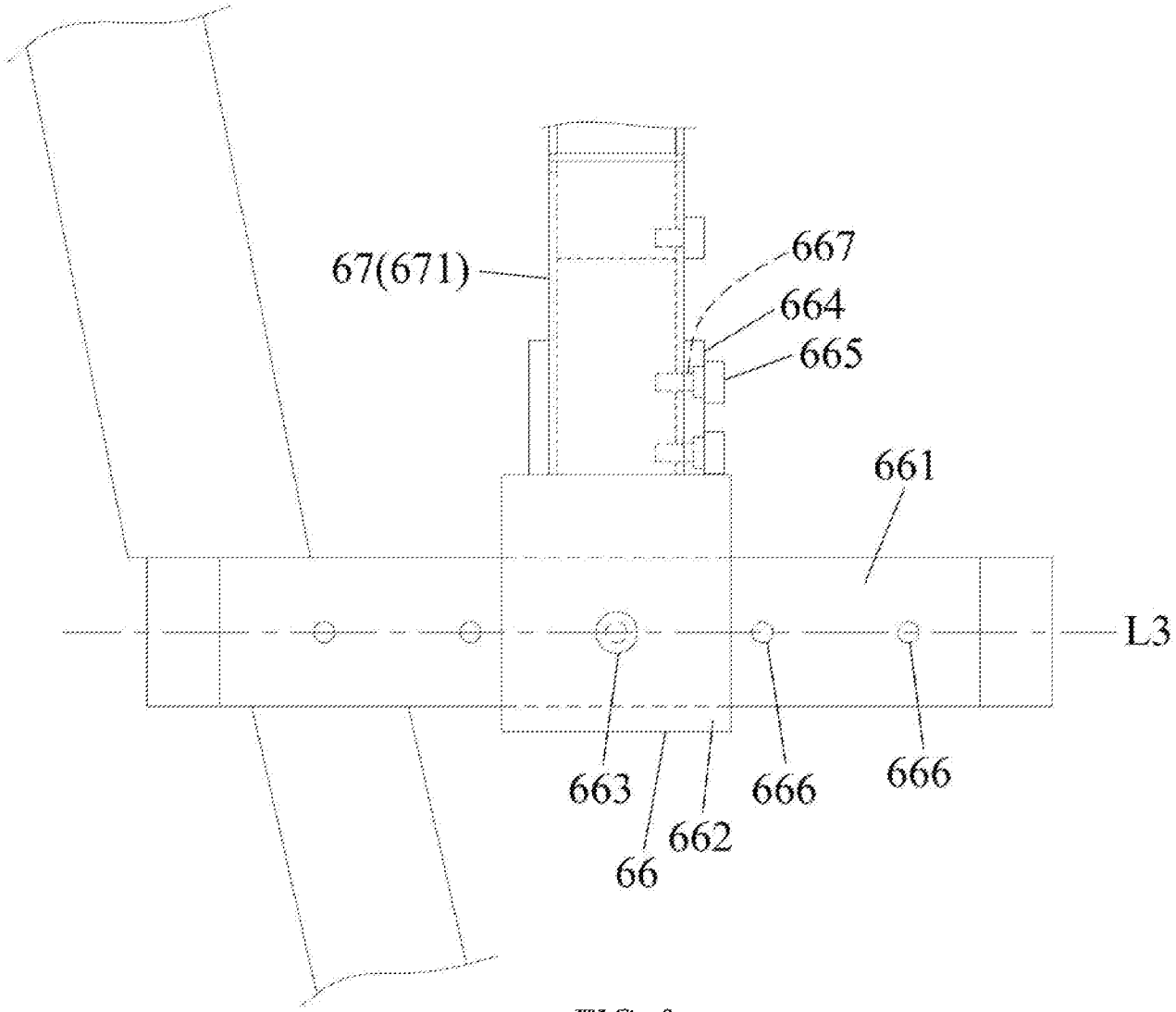
FIG. 8 is a partial side view of a seat cushion and a positioning armrest of a chair of the second embodiment of the present invention.
Figure 9:
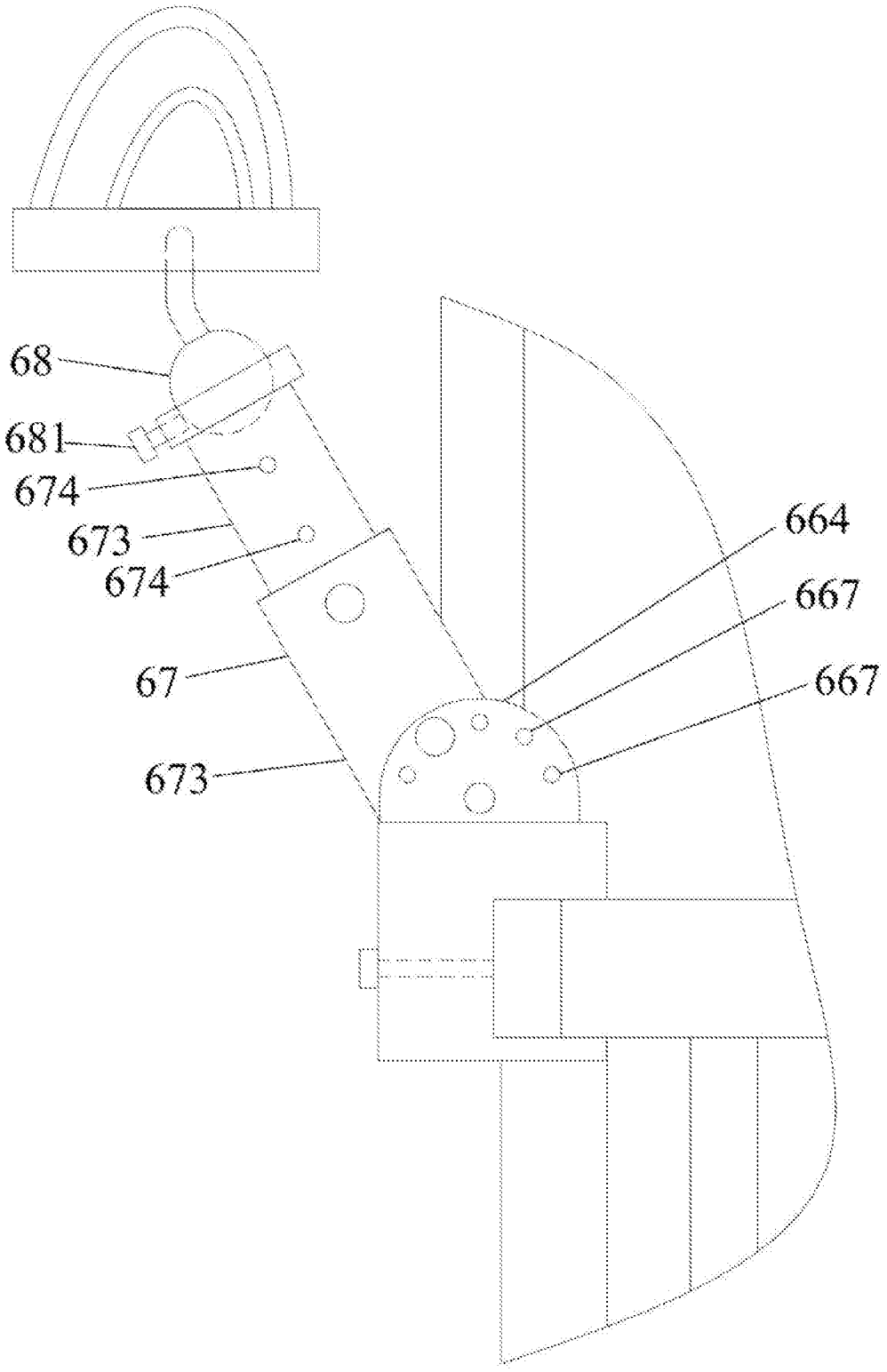
FIG. 9 is a partial front view of the positioning armrest of the chair of the second embodiment of the present invention.

Please refer to FIGS. 6, 8 and 9. The chair 6 is disposed on the base 31 and adjacent to the power unit 4 and the pulling unit 5, and the chair 6 comprises a support frame 61 disposed on the base 31, a seat 62 disposed on a top of the support frame 61, a seat back 63 disposed on a rear side of the seat 62 and extended upwardly, two fastening hooks 64 disposed on a front side 631 of the seat back 63 and arranged in interval along left and right directions of the seat back 63, and a positioning armrest 65 disposed on one of left and right sides of the seat 62. The fastening hook 64 is disposed on a front side 631 of the seat back 63 and bent forwardly and downwardly, and configured to fasten the patient's shoulder. The positioning armrest 65 is configured to adjust and locate a position of the patient's arm. The chair 6 can be designed according to the practical demand, to have the seat 62 with an adjustable height in a longitudinal direction, or a fixed height.

The positioning armrest 65 comprises a sliding member set 66 disposed on a side edge of the seat 62, a first arm 67 disposed on the sliding member set 66, a multi-directional connector set 68 connected to the first arm 67, a second arm 69 connected to the multi-directional connector set 68 and extended toward the front of the seat back 63, and a fastening member 70 disposed on the second arm 69. The first arm 67 comprises a bottom 671 pivoted to the sliding member set 66, and a top 672 opposite to the bottom 671. Relative to the seat 62, the bottom 671 of the first arm 67 is positioned rotatably about the third axis L3 which passes the bottom 671 and is extended along a front and rear directions of the seat 62. The top 672 is positioned retractably relative to the bottom 671. The sliding member set 66 is positioned slidably along the third axis L3 relative to the seat 62, so as to drive the first arm 67 to slide and position along the third axis L3. The second arm 69 is disposed on the top 672, and configured to place the patient's front arm. The fastening member 70 is configured to fasten the patient's front arm on the second arm 69. The second arm 69 comprises a rear end 691 connected to the multi-directional connector set 68, and a front end 692 opposite to the rear end 691. The multi-directional connector set 68 enables the front end 692 to longitudinally or horizontally swing and position relative to the horizontal swing of the top 672 of the first arm 67.

In this embodiment, the sliding member set 66 comprises a sliding track 661 disposed on the seat 62, a slider 662 disposed on the sliding track 661 slidably along the third axis L3 and configured to place the bottom 671 of the first arm 67, a first pin 663 inserted into the sliding track 661 and the slider 662, a fastening disk 664 fastened on the slider 662 and adjacent to the first arm 67, and a second pin 665 inserted to the fastening disk 664 and the first arm 67. Each of the sliding track 661 and the slider 662 has multiple first fastening holes 666, when the first pin is inserted into the two overlapping first fastening holes 666, the slider 662 can be positioned, and the bottom 671 of the first arm 67 is rotatably disposed on the slider 662 about the third axis L3. The fastening disk 664 comprises a plurality of second fastening holes 667, the second pin 665 is separately inserted into the first arm 67 and one of the second fastening holes 667, so that the slider 662 can be positioned, but the structure of the sliding member set 66 of the present invention is not limited to the example described herein. The first arm 67 is formed by mounting two sleeves 673 slidable relative to each other, and each the sleeve 673 has multiple through holes 674, and when a pin is inserted into two overlapping through holes 674, the slider 662 can be positioned, but the present invention is not limited thereto. The multi-directional connector set 68 can be a universal ball connector which can be fastened tightly by a fastening screw 681; in other embodiment, the multi-directional connector set 68 can be a cross connector, but the present invention is not limited thereto.

Figure 11:
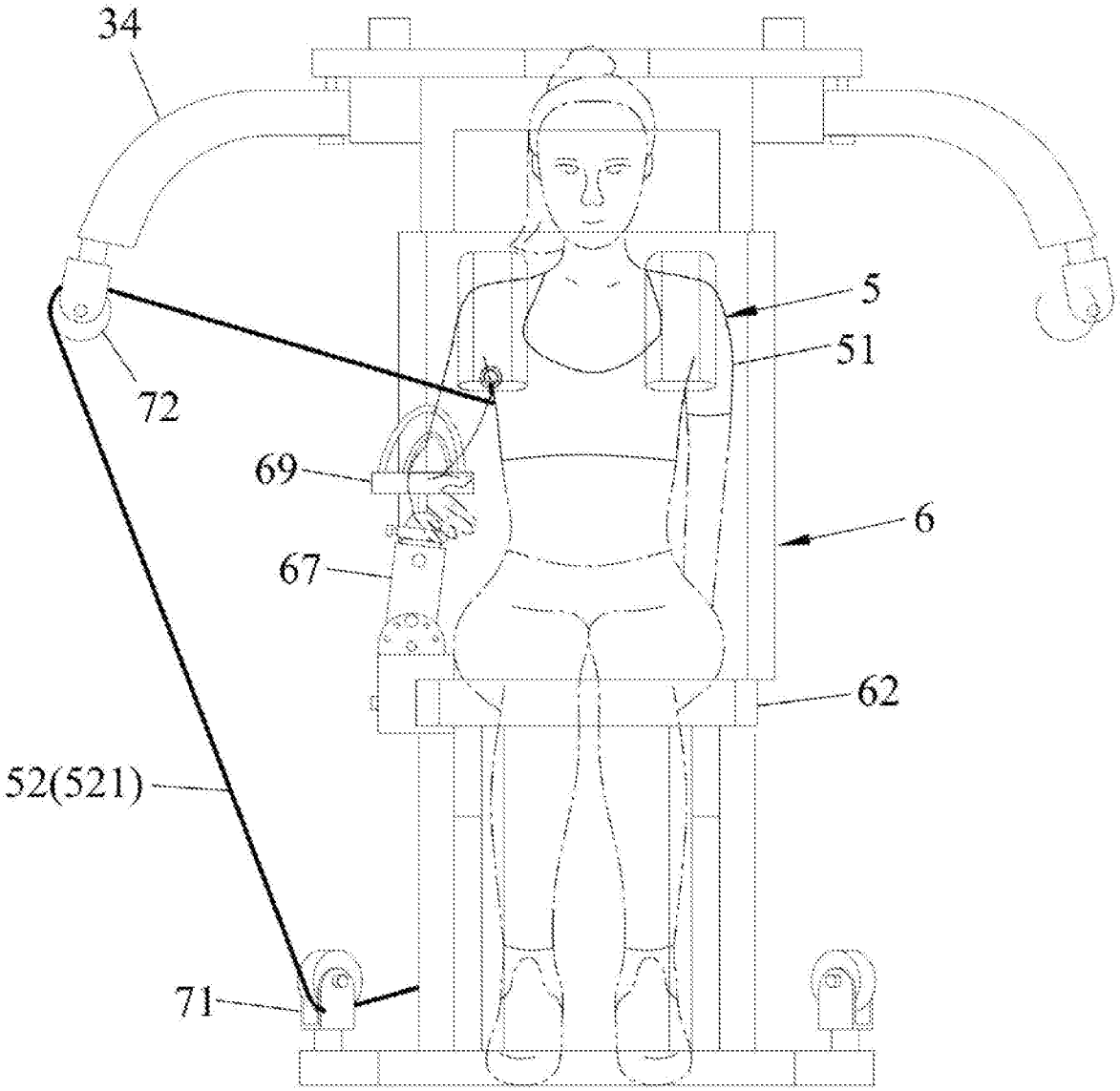
FIG. 11 is a schematic view of an operation of using the second embodiment of the present invention, to illustrate that the patient operates the second embodiment to outwardly mobilize a shoulder joint thereof.
Figure 12:
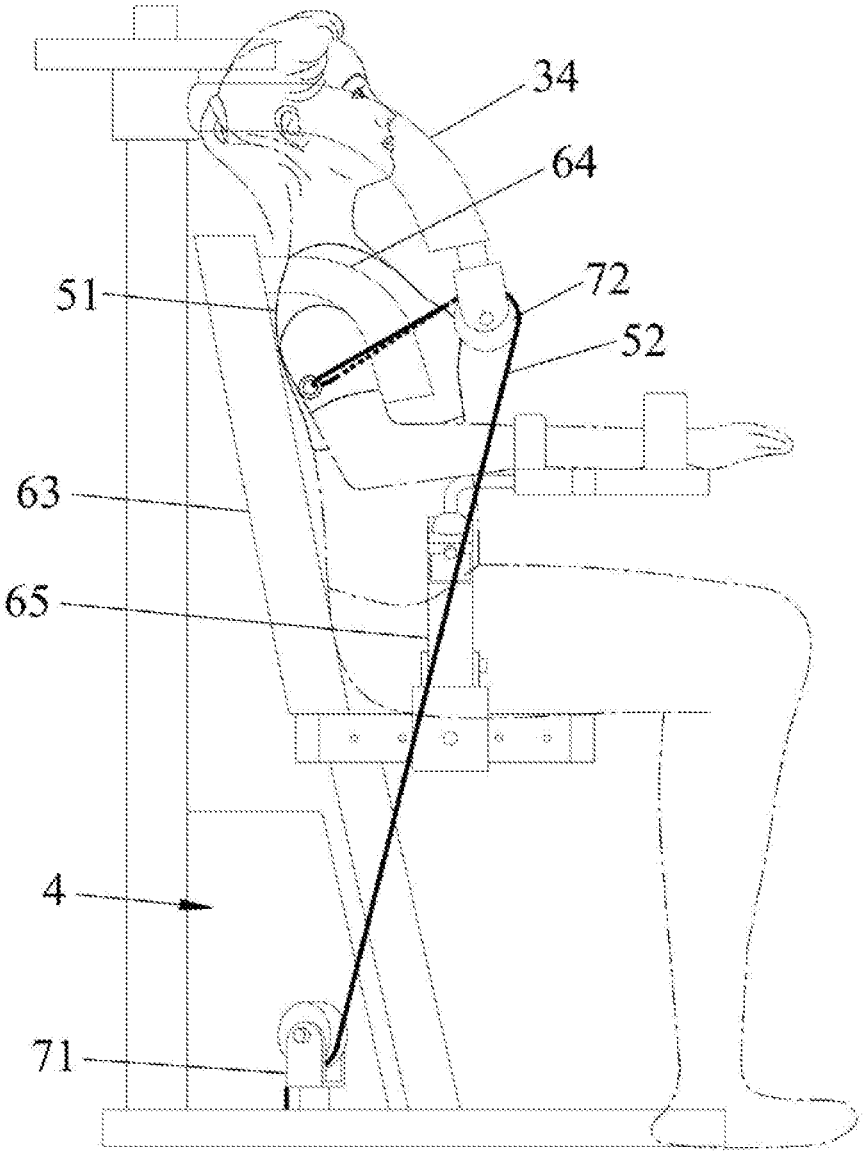
FIG. 12 is a schematic view of an operation of using the second embodiment, to illustrate that a patient operates the second embodiment to forwardly mobilize a shoulder joint thereof.
Figure 13:
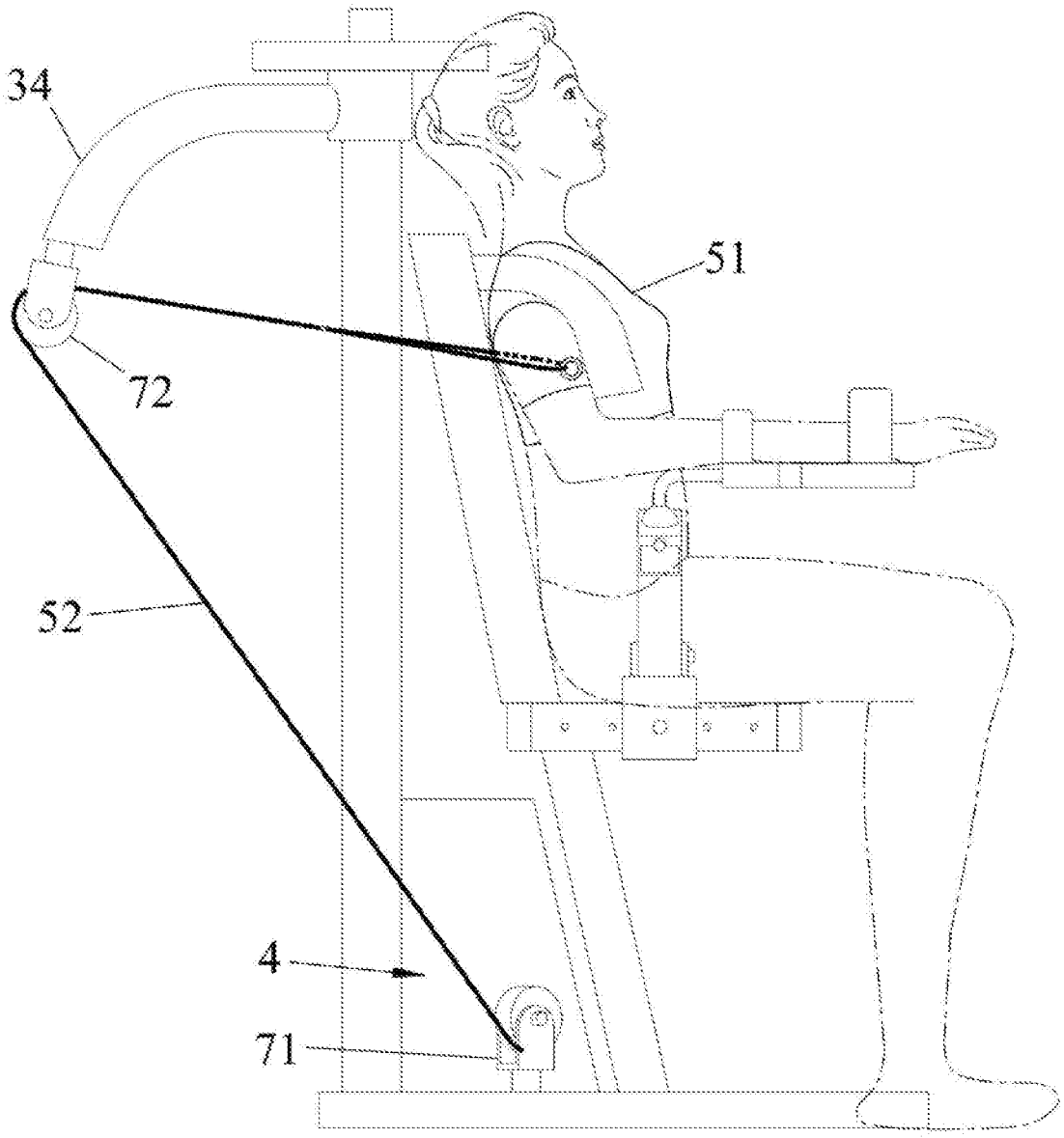
FIG. 13 is a schematic view of an operation of using the second embodiment, to illustrate that a patient operates the second embodiment to backwardly mobilize a shoulder joint thereof.

Please refer to FIGS. 6, 10 and 11. The turning unit 7 can be used to adjust the pulling direction of the rope set 52. The turning unit 7 comprises two first turning device sets 71 disposed on left and right sides of the base 31 and adjacent to the power unit 4, respectively, and two second turning device sets 72 disposed on the second ends 342 of the swingable arms 34, respectively. Each of the first turning device sets 71 and the second turning device sets 72 is configured to detachably wrap with the rope set 52, and each second turning device set 72 can be moved and positioned relative to the chair 6, by the swingable arm 34. Each of the first turning device sets 71 comprises a first wheel holder 711 rotatably disposed on the base frame 32, and a first turning wheel 712 rotatably disposed on the wheel holder 711 and configured to detachably mount with the rope set 52. Each of the second turning device sets 72 comprises a second wheel holder 721 rotatably disposed on the second end 342 of the swingable arm 34, and a second steering wheel 722 rotatably disposed on the second wheel holder 721 and configured to detachably wrap with the rope set 52.

Please refer to FIG. 10 to 13. The second embodiment can assist the therapist to perform joint mobilization and also facilitate a patient to operate independently. In use, the patient can wear the wearable member set 51 on a shoulder part thereof, and sit on the chair 6, and the patient's shoulder part is fastened between the fastening hook 64 and the seat back 63, and the patient's a front arm is placed on the second arm 69 of the positioning armrest 65, and fastened by the fastening member 70. According to the to-be-mobilized direction of the shoulder joint, the therapist or the patient can adjust the inclined angle and length of the first arm 67 of the positioning armrest 65 relative to the seat 62, and the angle of the second arm 69 relative to the first arm 67, so as to make the arm of the patient place on an appropriate position. Furthermore, by operating the first turning device set 71 and the second turning device set 72, the therapist or the patient can adjust the pulling direction of the rope set 52. After the patient places arm on an appropriate position, the patient can turn on the power unit 4 to drive the rope set 52 to pull the wearable member set 51 and the patient's shoulder joint, so as to perform pulling operation and mobilization. FIGS. 10 to 13 illustrate that the second embodiment is operated to perform joint mobilization on the patient's shoulder joint downwardly, outwardly, forwardly and backwardly, respectively. By controlling the positioning armrest 65 and the turning unit 7, the therapist or the patient can adjust different pulling direction, but the present invention is not limited thereto.

It is to be noted that this embodiment includes two swingable arms 34, two first turning device sets 71, and two second turning device sets 72 disposed correspondingly; however, other embodiment can include one swingable arm 34, one first turning device set 71 and one second turning device set 72 which are disposed on the same side as the positioning armrest 65. Furthermore, in other embodiment, the number of the positioning armrests 65 can be two, and the two positioning armrests 65 are disposed on left and right sides of the seat 62, respectively; the number of the ropes 521 of the rope set 52 is two, and the two ropes 521 are connected to the left and right sides of the power unit 4, respectively, and the wearable member set 51 is configured to mount on two shoulder joints of the patient and connect to the two ropes 521, so as to pull the two shoulder joints of the patient symmetrically, thereby more balancing the force applied on the patient.

According to above contents, the second embodiment has following advantages.

First, the power unit 4 and the pulling unit 5 can perform mobilization on the shoulder joint, instead of the therapist, so as to reduce the therapist's burden in physical strength and facilitate the patient to use independently.

Secondly, the fastening hook 64 and the positioning armrest 65 can effectively swing the patient's shoulder part and arm, so that the therapist does not need to hold the patient's arm during the joint mobilization process, and the patient can swing and position the arm thereof independently.

Thirdly, the pulling angle of the rope set 52 can be effectively and easily controlled by using the turning unit 7, to indeed achieve the effect of pulling the shoulder joint in different angles.

Fourthly, the turning unit 7 is in the form of a turning wheel, so as to make the pulling operation and reciprocation of the rope set 52 more smooth without being worn easily.

Figure 14:
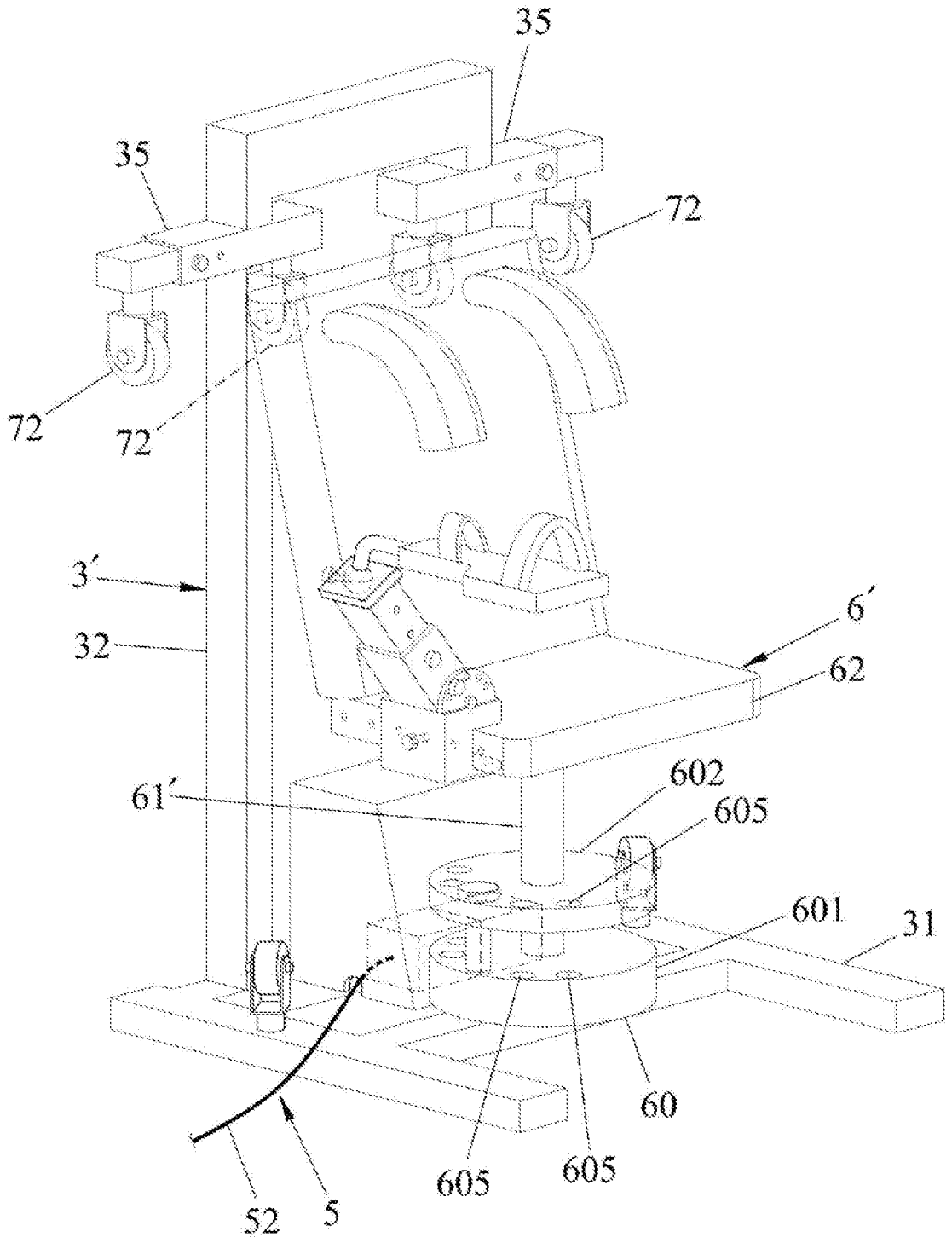
FIG. 14 is a perspective view of a third embodiment of a joint mobilization apparatus of the present invention.
Figure 15:
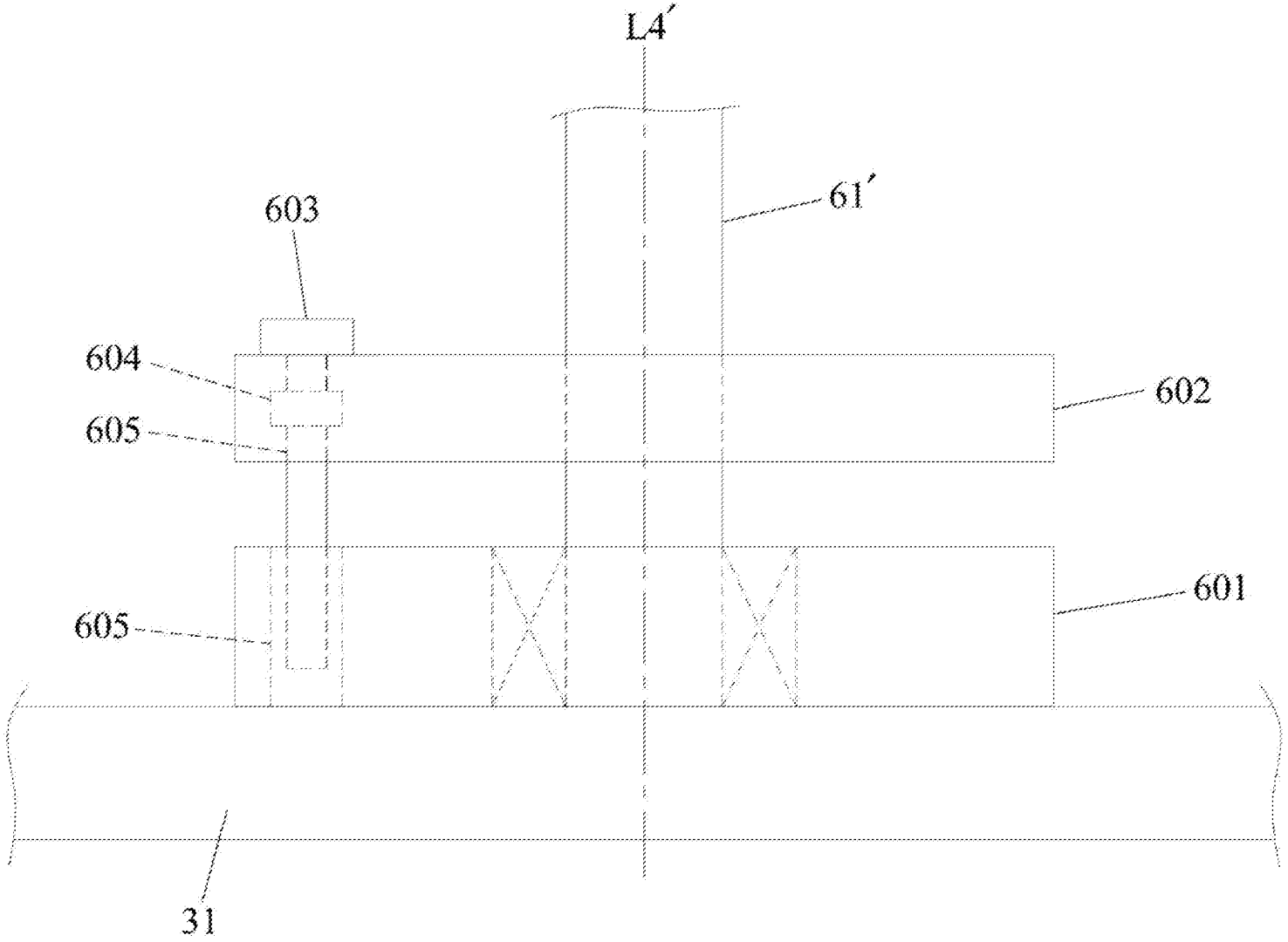
FIG. 15 is a partial perspective view of a chair of the third embodiment of the present invention.

Please refer to FIGS. 14 and 15. A third embodiment of an joint mobilization apparatus of the present invention is similar to the second embodiment, and the difference between the second embodiment and the third embodiment is that the chair 6' of the third embodiment comprises a positioning member set 60 disposed on the base 31, and a support frame 61' disposed on the positioning member set 60 rotatably relative to the positioning member set and about the fourth axis IA which passes through the support frame 61' and extended longitudinally. The support frame 61' can be used to drive the seat 62 to rotate. The positioning member set 60 can be used to position the support frame 61'. In this embodiment, the positioning member set 60 of the chair 6' has a positioning disk 601 fixed to the base 31, a driven disk 602 disposed on the support frame 61' and rotatable along with the support frame 61', a positioning pin 603 inserted into the fastening disk and the driven disk 602, and an elastic member 604 connected to the positioning pin 603 and the driven disk 602. Each of the positioning disk 601 and the driven disk 602 has multiple corresponding positioning holes 605 formed thereon, the positioning pin 603 can be inserted in two overlapping positioning holes 605, and pulled away from the positioning disk 601. The elastic member 604 can make the positioning pin 603 to be inserted constantly in the direction toward the positioning disk 601.

The base unit 3' comprises two lateral support rods 35 disposed on the base frame 32 and extended in a horizontal direction. The number of the second turning device sets 72 is two, and the two second turning device sets are disposed on the lateral support rods 35, respectively. In this embodiment, an outer end of each lateral support rod 35 can be retracted and positioned along a length direction thereof, so that the second turning device set 72 located on the outer end can be moved close to or away from the base frame 32 along the length direction of the lateral support rod 35. In other embodiment, the second turning device set 72 is slidably disposed on the lateral support rod 35, or the number of the first turning device sets 71 is multiple, and the multiple first turning device sets 71 are disposed on the lateral support rod 35 along the length direction of the lateral support rod 35.

The third embodiment can achieve the purpose and effect the same as that of the second embodiment, and the difference between the second embodiment and the third embodiment is that the third embodiment adjusts the angle of the seat 62 to adjust the angle between the patient's shoulder part, the first turning device set 71 and the second turning device set 72 in order to adjust the pulling direction of the rope set 52, so as to achieve the effect of adjusting the pulling angle of the rope set 52. Furthermore, the pulling angle of the rope set 52 can be further fine-tuned by moving multiple second turning device sets 72 close to or away from the base frame 32.

According to above-mentioned contents, the joint mobilization apparatus of the present invention can use the power unit 2 (or 4) and the pulling unit 1 (or 5) to mobilize the patient's joint part, instead of the therapist, so as to reduce the therapist's burden in physical strength and facilitate the patient to use independently, thereby indeed achieving the objective of the present invention.

Figure 16:
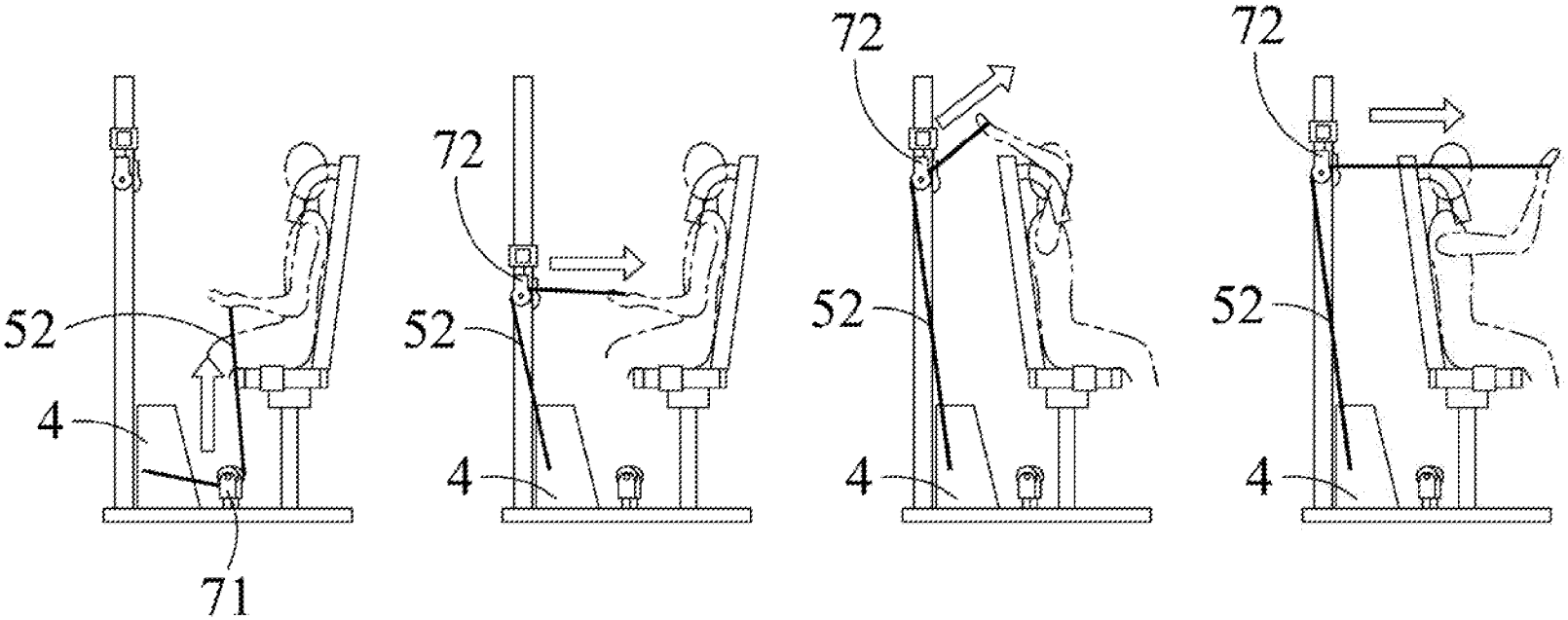
FIG. 16 is a schematic view of various muscle training mode of a joint mobilization apparatus of the present invention.

According to above-mentioned contents, the joint mobilization apparatus of the present invention can provide a user the to execute various muscle training modes. Please refer to FIG. 16. A servo motor can be used to provide the driving power of the joint mobilization apparatus of the present invention. The servo motor can be controlled by a program to adjust rotational velocity, output torque. By setting the servo motor to generate different pull forces or tensions in output process, the pull force or tension can vary over time or distance, so as to generate various force output modes. According to the above-mentioned features, the above-mentioned embodiment of the joint mobilization apparatus can change the setting and operation thereof quickly. After the user sets the joint mobilization apparatus, the user can move a part of the body against the pull force generated by the power source of the joint mobilization apparatus, as shown in FIG. 16, so as to perform biceps and deltoid muscle training, rowing exercise machine training, triceps training, or chest push-up and muscle rotation training; as a result, the joint mobilization apparatus of the present invention can execute various special muscle training modes, such as a vibration muscle training mode, an accurate eccentric and concentric contraction of muscles and antagonist training mode, and a the isokinetic movement training mode.

Figure 17:
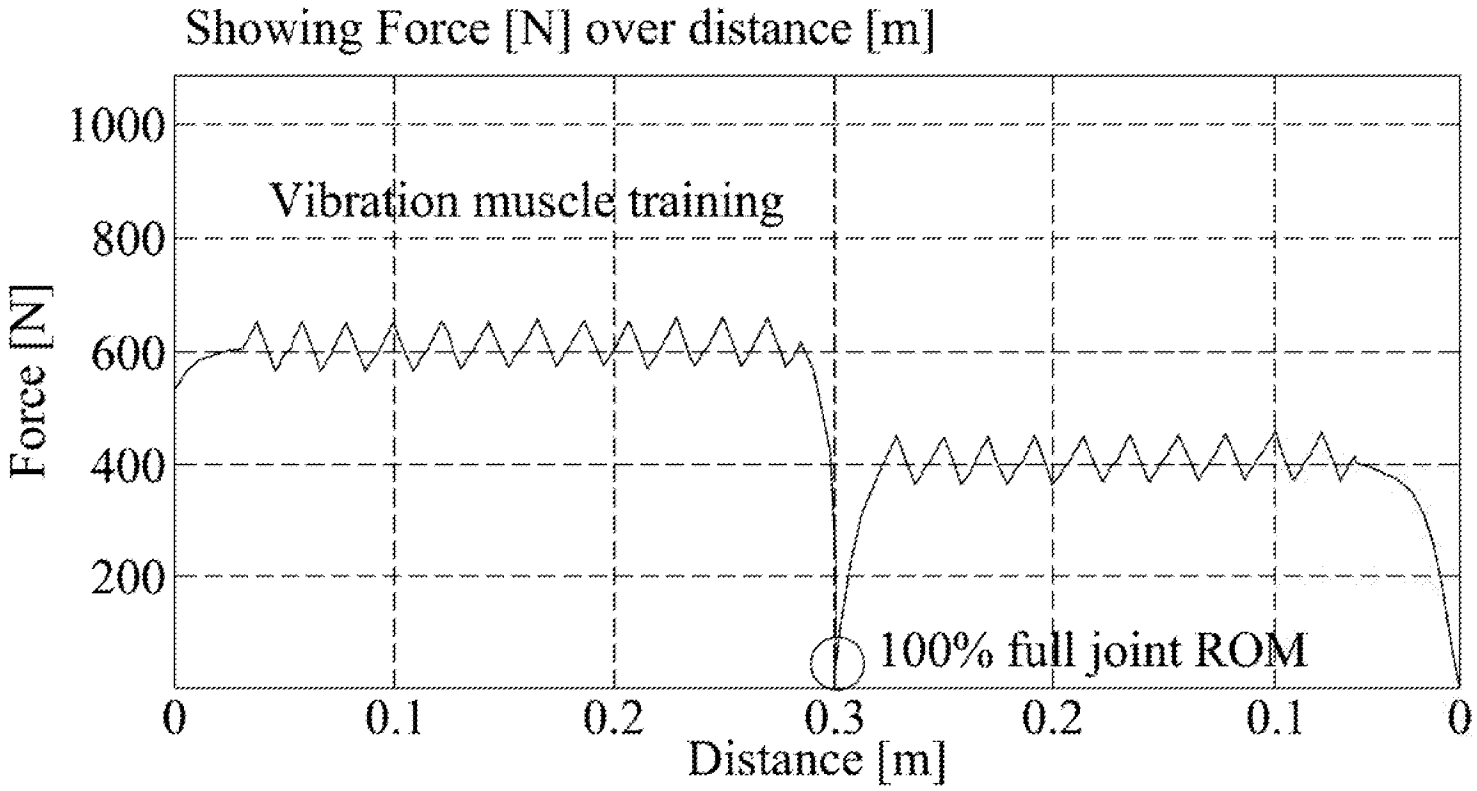
FIGS. 17 to 19 are schematic views of the power unit generating different output modes according to the present invention.

In the vibration muscle training mode, the joint mobilization apparatus of the present invention can use the servo motor, which can be controlled by the program, to adjust the rotation and output torque thereof according to user's operation and force. For example, the joint mobilization apparatus can generate continuous and different torques and pull forces, to generate a continuous pulling force. After the user sets the operation according to aforementioned embodiment, the user can start training against the continuous pulling force generated by the motor, so as to effectively the execute vibration muscle training mode, as shown in FIG. 17.

Figure 18:
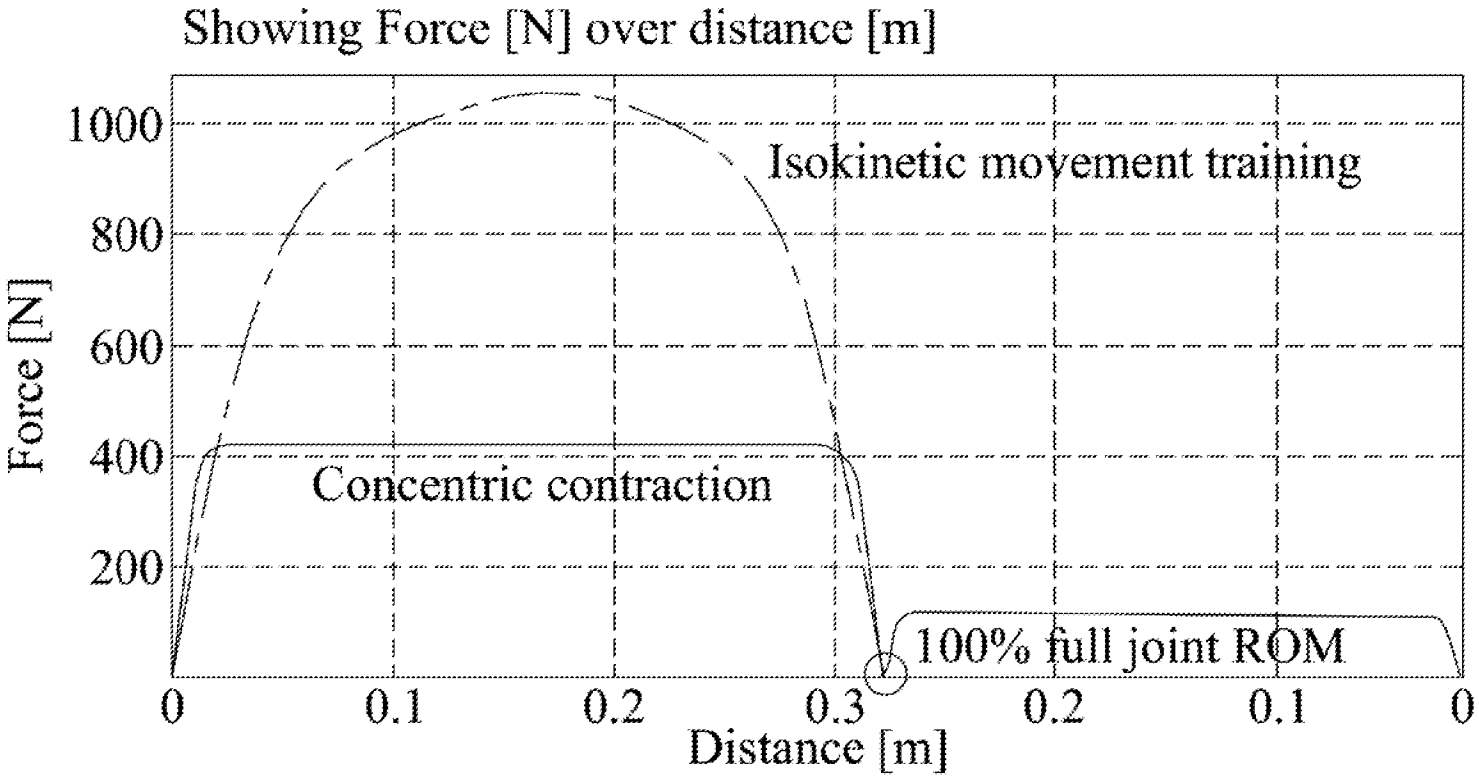

When human muscle works, muscle shortening action is called as concentric contraction, and muscle stretching action is called as eccentric contraction. The muscle completing the action is called as an agonist, and the muscle in cooperation with the action is called as an antagonist, and the coordination co-operation of these two types of muscles is a main factor of action. For example, while the user curls dumbbell up by an arm thereof the biceps serves as the agonist for concentric contraction and the triceps serves as the antagonist for eccentric contraction during the curling action, and the condition is opposite when the arm puts down the dumbbell. In a muscle training action with a constant force, a trainer' muscle is often injured because the constant force meets the requirement during the concentric contraction process but the muscle is excessively stretched and pulled during the eccentric contraction process Therefore, when the training force for the eccentric contraction and concentric contraction of the agonist and antagonist groups can be set accurately and independently, the user can execute muscle training safer and more effective. In the accurate eccentric and concentric contraction of muscles and antagonist training mode, the joint mobilization apparatus of the present invention can use the servo motor, which can be controlled by a program, to generate different pull forces or tensions during the output process, according to the eccentric and concentric contraction of the agonist and antagonist to be trained. FIG. 18 shows the different output forces on the specific sections in which the user acts different muscles. As a result, the present invention can achieve the safer and more effective training for the eccentric and concentric contraction of the agonist and antagonist.

Thirdly, different forces are generated during an action because of musculoskeletal structure; for example, during squat-down and stand-up action, the force generated when the knee joint is to straighten is larger than the force generated when the knee joint is squatted down. Therefore, in the isokinetic movement training mode, the joint mobilization apparatus of the present invention can use the servo motor, which can be controlled by a program, to generate different pull forces or tensions during the output process according to user operation and force; that is, the joint mobilization apparatus of the present invention can generate different forces along with the training operation, for example, the joint mobilization apparatus generates smaller resistive pull force in the beginning of the training action in which the use applies a smaller force, and generates a larger resistive pull force in the middle section of the training action in which the user applies a larger force, as shown in FIG. 18. With the aforementioned operation setting of the joint mobilization apparatus of the present invention, the user can execute training with the forces most matching with the action thereof, so as to achieve the most efficient and safest muscle rehabilitation training.

Figure 19:
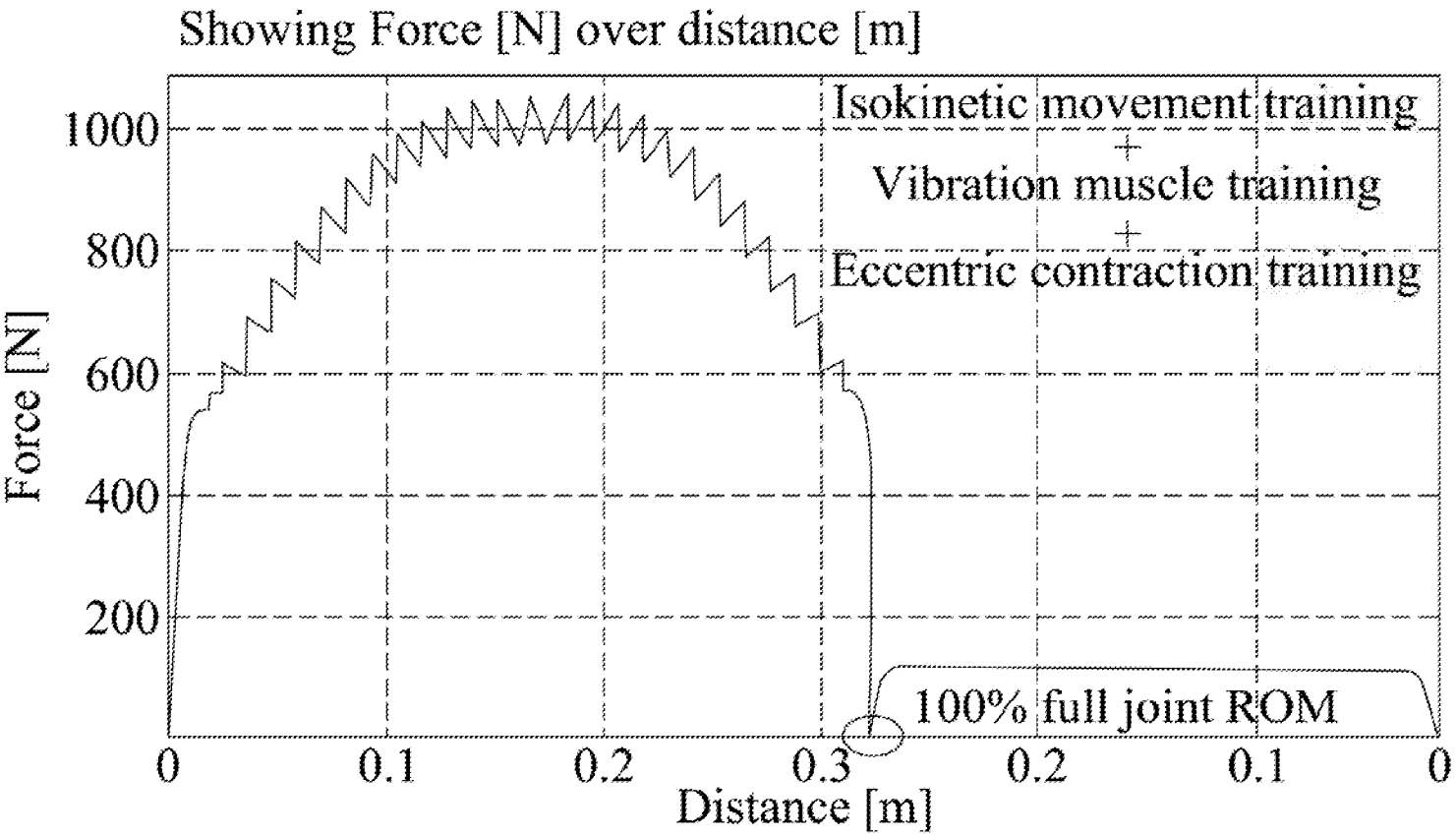

Fourthly, the manner of controlling the servo motor by a program can combine the various muscle training modes to form a unique training mode of the present invention, so as to achieve the most efficient muscle rehabilitation training, as shown in FIG. 19.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A joint mobilization apparatus, comprising:

a pulling unit comprising a wearable member set configured to mount on a patient's joint part, and a rope set connected to the wearable member set; and a power unit configured to provide power of reciprocatingly pulling the rope set, wherein the power unit comprises a shell member, a motor disposed in the shell member, and a reciprocation mechanism disposed in the shell member and connected to the motor and the rope set, the reciprocation mechanism is configured to be driven by the motor to reciprocate relative to the shell member, so as to pull the rope set to reciprocate the wearable member set and the patient's joint part;

wherein the reciprocation mechanism of the power unit comprises a rotary disk disposed inside the shell member and rotatably mounted on the shell member about a first axis, a guiding holder disposed on the shell member and in communication with the inside and outside of the shell member, a sliding member slidably disposed on the guiding holder along a second axis perpendicular to the first axis, a link rod having a length direction perpendicular to the first axis and having two ends pivoted with the rotary disk and the sliding member, respectively, wherein the link rod is pivoted with an end of the rotary disk and deviated from the first axis, the sliding member is connected to the rope set of the pulling unit, the motor is connected to the rotary disk and configured to drive the rotary disk to rotate, so as to drive the sliding member to slide reciprocatingly relative to the guiding holder, along the second axis, wherein the rotary disk comprises a plurality of pivot points deviated from the first axis and configured to provide a pivot point for the link rod, distances from the pivot points to the first axis are not the same, and the link rod is detachably pivoted on one of the plurality of pivot points.

2. The joint mobilization apparatus according to claim 1, wherein the power unit comprises a weight member set detachably connected to the shell member, and the weight member set comprises a rope connected to the shell member, and a weight member connected to an end of the rope opposite to the shell member.

3. A joint mobilization apparatus, comprising:

a pulling unit comprising a wearable member set configured to mount on a patient's joint part, and a rope set connected to the wearable member set; and a power unit configured to provide power of reciprocatingly pulling the rope set, wherein the power unit comprises a shell member and a motor disposed in the shell member, the motor is configured to pull the rope set to reciprocate the wearable member set and the patient's joint part;

a base unit comprising a base configured to fasten the power unit, and a base frame disposed on the base and extended upwardly;

a chair disposed on the base and adjacent to the power unit and the pulling unit, and comprising a support frame disposed on the base, a seat disposed on a top of the support frame, a seat back disposed on a rear side of the seat and extended upwardly, two fastening hooks disposed on a front side of the seat back and arranged to be separated from each other in left and right directions of the seat back, and at least one positioning armrest disposed on one of left and right sides of the seat, respectively, wherein the two fastening hooks are configured to fasten the patient's shoulder, the at least one positioning armrest is configured to adjust and position the patient's arm, the at least one positioning armrest comprises a first arm disposed on the seat, a second arm connected to the first arm and extended toward a front side of the seat back, and a fastening member disposed on the second arm, wherein the first arm comprises a bottom pivoted to the seat, and a top opposite to the bottom, and the bottom is positioned and rotatable relative to the seat, about a first axis which passes through the bottom and extended along a front and rear directions of the seat, wherein the top is positioned and retractable relative to the bottom, the second arm is disposed on the top and configured to support the patient's front arm, and the fastening member is configured to fasten the patient's front arm on the second arm; and a turning unit configured to adjust a pulling direction of the rope set, and comprising at least one first turning device set disposed on the base and adjacent to the power unit, and at least one second turning device set disposed on the base frame, wherein the at least one first turning device set and the at least one second turning device set are configured to detachably wrap with the rope set, and the at least one second turning device set and the chair are positioned and movable relative to each other.

4. The joint mobilization apparatus according to claim 3, wherein the base unit comprises at least one positioning member set disposed on the base frame, and at least one swingable arm connected to the at least one positioning member set and extended toward a direction away from the base frame, the at least one swingable arm has a first end connected to the at least one positioning member set, and a second end opposite to the first end, wherein the second end is rotatable relative to the at least one positioning member set, about a second axis passing through the at least one positioning member set and extended in a longitudinal direction, the at least one positioning member set is configured to position the at least one swingable arm, the at least one second turning device set is disposed on the second end of the at least one swingable arm.

5. The joint mobilization apparatus according to claim 3, wherein the chair comprises a positioning member set disposed on the base, the support frame of the chair is disposed on the positioning member set, the support frame is rotatable relative to the positioning member set, about a second axis passing through the support frame and extended in a longitudinal direction, so as to drive the seat to rotate, and the positioning member set is configured to position the support frame.

6. The joint mobilization apparatus according to claim 5, wherein the base unit comprises at least one lateral support rod disposed on the base frame and extended in a horizontal direction, the at least one first turning device set is disposed on the at least one lateral support rod, and the at least one second turning device set is movable close or away from the base frame along a length direction of the at least one lateral support rod.

7. The joint mobilization apparatus according to claim 5, wherein the base unit comprises at least one lateral support rod disposed on the base frame and extended in a horizontal direction, the number of the at least one first turning device set is multiple, and the multiple first turning devices are disposed on the at least one lateral support rod in interval along a length direction of the at least one lateral support rod.

8. The joint mobilization apparatus according to claim 3, wherein the at least one positioning armrest of the chair comprises a multi-directional connector set configured to pivot and position the first arm and the second arm, the second arm comprises a rear end connected to the multi-directional connector set, and a front end opposite to the rear end, the front end is swingable in longitudinal and horizontal directions relative to a top of the first arm.

9. The joint mobilization apparatus according to claim 3, wherein the at least one positioning armrest of the chair has a sliding member set disposed on a side edge of the seat, a bottom of the first arm is pivoted to the sliding member set, the sliding member set is positioned and slidable relative to the seat along the first axis, so as to drive the first arm to position and slide along the first axis.

10. The joint mobilization apparatus according to claim 3, wherein the at least one first turning device set comprises a first wheel holder rotatably disposed on the base frame, and a first turning wheel rotatably disposed on the wheel holder and configured to detachably mount with the rope set, the at least one second turning device set comprises a second wheel holder rotatably disposed on the second end of the swingable arm, and a second steering wheel rotatably disposed on the second wheel holder and configured to detachably wrap with the rope set.

11. The joint mobilization apparatus according to claim 3, wherein the motor of the power unit is a servo motor controlled by a program to adjust a rotational velocity or an output torque or a vibration frequency thereof, and the joint mobilization apparatus is configured to be set according to a user's operation and force, to generate different types and modes of force during the user action process, wherein the joint mobilization apparatus is configured to be set with different user actions to execute various special muscle training modes.

* * * * *